US005735243A

United States Patent [19]

Asai et al.

[11] Patent Number: 5,735,243

[45] Date of Patent: Apr. 7, 1998

[54] CONTROLLER FOR PREVENTING THROTTLE VALVE FROM LOCKING AT ITS FULLY CLOSED POSITION

[75] Inventors: Toshimichi Asai; Sunao Kitamura, both of Obu, Japan

[73] Assignee: Aisan Kogyo Kabushiki Kaisha, Obu, Japan

[21] Appl. No.: 874,671

[22] Filed: Jun. 13, 1997

[30] Foreign Application Priority Data

Jun. 17, 1996 [JP] Japan ..... 8-155569

[51] Int. Cl.[6] ..... F02D 7/00

[52] U.S. Cl. ..... 123/396

[58] Field of Search ..... 123/396, 361, 123/399, 400, 403, 492, 198 D, 198 DB, 395

[56] References Cited

U.S. PATENT DOCUMENTS 5,163,402 11/1992 Taguchi et al. ..... 123/396
5,297,521 3/1994 Sasaki et al. ..... 123/396
5,601,063 2/1997 Ohashi et al. ..... 123/396
5,664,539 9/1997 Viera ..... 123/198 DB

FOREIGN PATENT DOCUMENTS 2-091432 3/1990 Japan ..... 123/396
3-271528 12/1991 Japan ..... 123/396

*Primary Examiner*—Raymond A. Nelli
*Attorney, Agent, or Firm*—Dennison, Meserole, Pollack & Scheiner

[57] ABSTRACT

A throttle valve controller for controlling an opening angle of a throttle valve used to adjust power of, for example, a vehicle or ship engine, the throttle valve controller including a throttle lever fixed to a throttle shaft of a throttle valve, a return spring for biasing the throttle lever in the valve closing direction, a relief lever rotatably attached to the throttle shaft, a relief spring having a biasing force larger than that of the return spring interposed between the throttle shaft and the relief lever, engaging pieces of relief lever and the throttle lever, a stopper for the relief lever, a kick lever rotated by an operation of an accelerator, and an interlocking device of the kick lever with the relief lever.

2 Claims, 5 Drawing Sheets

CONTROLLER FOR PREVENTING THROTTLE VALVE FROM LOCKING AT ITS FULLY CLOSED POSITION

BACKGROUND OF THE INVENTION

1. Field of the Invention

This invention relates to a throttle valve controller for controlling an opening angle of a throttle valve used to adjust power of, for example, a vehicle or ship engine, and more particularly to a throttle valve controller having a function for prohibiting the throttle valve from being fully closed when a motor for rotating the throttle valve is not energized and when an accelerator to be operated by an operator is not operated.

2. Description of the Prior Art

Engine power can be computer-controlled by adjusting an opening angle of a throttle valve with a motor. In a throttle valve controller having the motor, a throttle shaft is biased in a valve closing direction by a spring, and the throttle valve is rotated against the spring force by the motor in a valve opening direction. With this mechanism, the throttle valve is fully-closed by the spring when the motor is not energized.

When the throttle valve is kept at its fully closed position at a low temperature for a long time, there is a possibility that a peripheral edge of the throttle valve is frozen to a wall of an intake passage. Once being frozen, the throttle valve cannot be opened from its fully closed position when the motor is energized again. Besides the freezing, sticky substance may be deposited between the wall of the intake passage and the peripheral edge of the throttle valve placed at its fully closed position, thus making the throttle valve locked at its fully closed position.

In order to solve the above problem, the inventors of the present invention have developed a technique in which the throttle valve is adapted to be kept open from its fully closed position when the motor is not energized, and in which, from this initial position, it is opened and closed by the motor. This technique is disclosed in Japanese Laid-Open Patent Publication No. 3-271528.

With the motor-controlled throttle valve, a trouble of an electrical system makes the throttle valve control impossible. For providing against the trouble of the electrical system, various techniques for mechanically controlling the throttle valve in association with operation of an accelerator by an operator have been proposed in order to permit running of vehicles or the like (for example, Japanese Laid-Open Patent Publication No. 2-91432). This type of throttle valve controller has both the electrical system and the mechanical system. With this type, when the motor is not energized and when the accelerator is not operated, the throttle valve is kept at its fully closed position. When this closed position is maintained for a long time, the throttle valve will be locked at its fully closed position and can not be opened again.

To solve this problem, it seems that the above described technique disclosed in Japanese Laid-Open Patent Publication 3-271528 is promising. However, it is not easy to incorporate the technique into a construction in which the electrical system and the mechanical system coexist.

Accordingly, in case of the throttle valve controller in which the above-described two systems, that is, the electrical system and the mechanical system coexist, no effective technique has been realized to prevent the throttle valve from being locked at its fully closed position when the throttle valve is kept at its fully closed position for a long time.

SUMMARY OF THE INVENTION

Accordingly, an object of the present invention is to provide a throttle valve controller in which both an electrical system and a mechanical system are incorporated and in which a throttle valve is prevented from being locked at its fully closed position even when a motor for rotating the throttle valve is not energized and when an accelerator to be operated by an operator is not operated for a long time.

Another object of the present invention is to reduce a torque required for the motor.

A throttle valve controller according to the present invention comprises a throttle shaft (4) supported by a body (1) such that a throttle valve (5) can be rotated with the shaft (4) in an intake passage formed in the body (1) for opening and closing the intake passage, a motor (2) for rotating the throttle shaft (4), a throttle lever (7) fixed to the throttle shaft (4), a return spring (8) for biasing the throttle shaft (4) in a valve closing direction, a relief lever (6) being able to rotate with respect to the throttle shaft (4), a relief spring (10) interposed between the throttle shaft (4) and the relief lever (6) for biasing the throttle shaft (4) in a valve opening direction with respect to the relief lever (6) and for biasing the relief lever (6) in a valve closing direction with respect to the throttle shaft (4) by a biasing force greater than that of the return spring (8), a stopper (9) for stopping rotation of the relief lever (6) in the valve closing direction at a position where the throttle valve (5) is opened by a predetermined angle from a fully closed position and a kick lever (18) being rotated by an operation of an accelerator by an operator. An engaging member (6*a*) is formed on the relief lever (6) for engaging the throttle lever (7), the relief lever (6) being positioned in the valve opening side of the throttle lever (7). An engaging member (18*a*) is formed on the kick lever (18) for engaging the relief lever (6) when the kick lever (18) is rotated in the valve opening direction greater than a predetermined angle, the kick lever (18) being positioned in the valve closing side of the relief lever (6).

With the above-described construction, the throttle valve can be opened and closed by the motor (2), and when the motor is in trouble, it can be mechanically opened by the operation of the accelerator. Further, when the motor is not energized and the accelerator is not operated, the throttle valve is maintained in a position slightly opened from the fully closed position, thus preventing the throttle valve from being locked at its fully closed position.

Specifically, when the motor (2) is not energized and the kick lever (18) is not rotated, the throttle lever (7) and the relief lever (6) are maintained in a mutually engaged condition by the biasing force of the relief spring (10), and in this condition, the throttle lever (7) is biased by the biasing force of the return spring (8) in the valve closing direction. In this condition, both the relief lever (6) and the throttle lever (7) are rotated in the valve closing direction by the biasing force of the return spring (8) and both levers (6,7) are stopped at a position where the relief lever (6) is in contact with the stopper (9). Although the throttle lever (7) is biased in the valve closing direction by the return spring (8), the biasing force in the valve opening direction by the relief spring (10) is greater than the biasing force in the valve closing direction by the return spring (8) so that the throttle lever (7) is kept in engagement with the relief lever (6). Thus, the throttle valve (5) is maintained in a position opened by the predetermined angle from its fully closed position. The slightly opened position is referred to as an initial opening angle.

In a normal state of engine operation, the motor is driven depending on an operational amount of the accelerator and an actuation condition of the engine, and the throttle valve is opened and closed by the motor. When the throttle valve is closed to an angle smaller than the initial opening angle, the throttle shaft (4) is rotated by the motor (2) in the valve closing direction even after the relief lever (6) is prohibited by the stopper (9) from rotating further in the valve closing direction. On the other hand, when the throttle valve is opened to an angle greater than the initial opening angle, the throttle shaft is rotated in the valve opening direction against the biasing force of the return spring while the throttle lever engages the relief lever.

When a certain trouble of the electrical system causes the motor (2) to be in a stopped state (non-energized state), the throttle valve is positioned in the initial opening angle as in the engine stopped state. When the accelerator is operated in this state, the kick lever engages the relief lever to thereby rotate the relief lever in the valve opening direction. In association with the rotation of the relief lever, the throttle lever which engages the relief lever by the biasing force of the relief spring is rotated in the valve opening direction. Thus, the throttle valve can be opened by the operation of the accelerator. In this case, the throttle valve cannot be closed to an angle smaller than the initial opening angle of the throttle valve. However, this does not yield a serious problem even in an abnormal condition.

The present invention will be more fully understood from the following detailed description and appended claims when taken with the accompanying drawings.

DETAILED DESCRIPTION OF THE PREFERRED EMBODIMENTS

Figure 1:
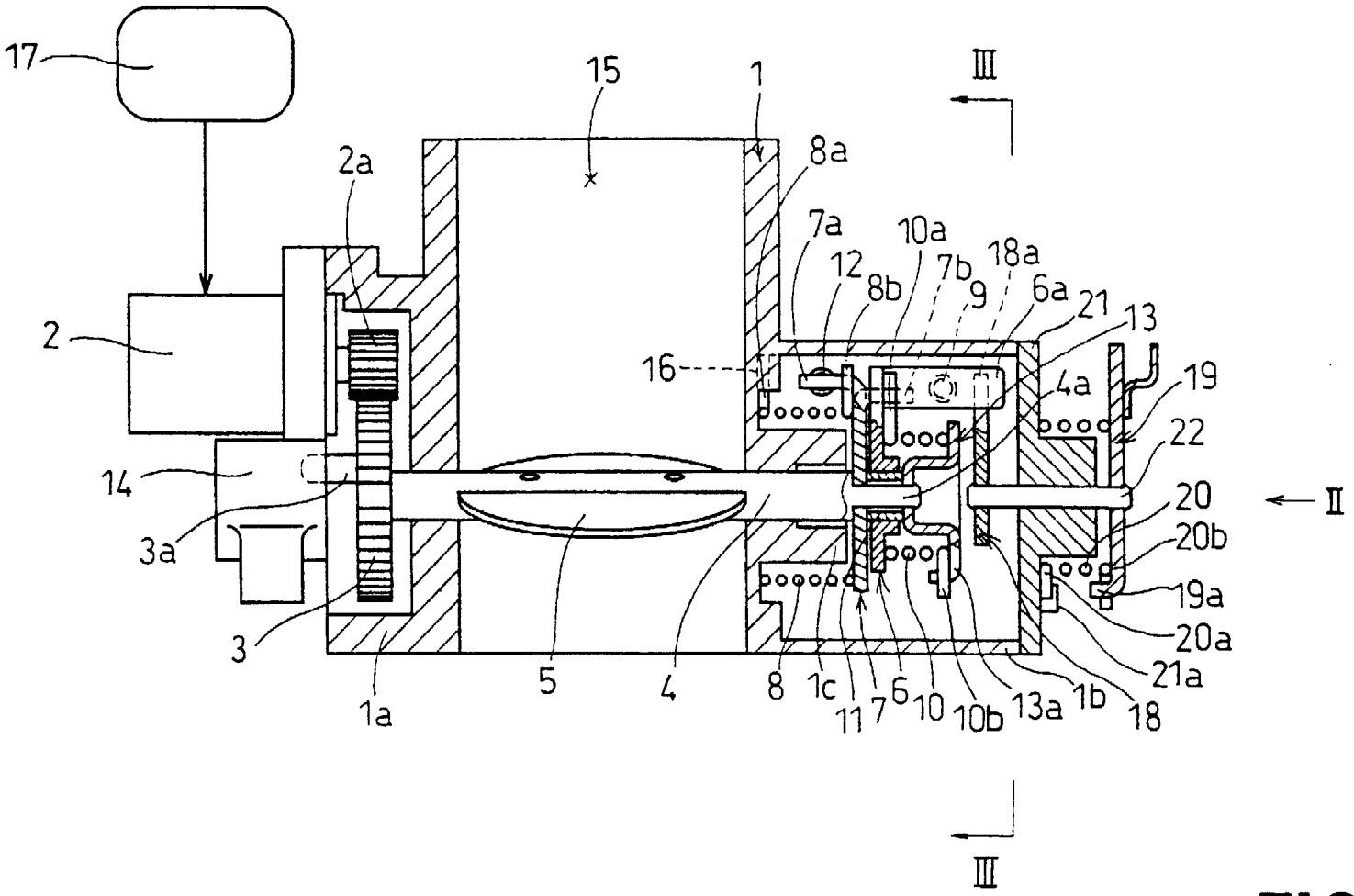
FIG. 1 is a front sectional view of a throttle valve controller according to an embodiment of the present invention.

A throttle valve controller according to an embodiment of the present invention will now be described with reference to FIGS. 1 to 9. In FIG. 1 and FIG. 3 each illustrating a front sectional view of a throttle controller and a sectional view taken along line III—III of FIG. 1, a body 1 having an intake passage 15 therein is formed into a cylindrical shape. The intake passage 15 is a part of an intake passage of a vehicle engine.

Both ends of a throttle shaft 4 are rotatably supported at opposite portions of a wall of the body 1 such that both ends of the shaft 4 penetrate through the wall. The throttle shaft 4 has a throttle valve 5 provided for opening and closing the intake passage 15. In FIG. 3, the throttle valve 5 rotates in counterclockwise direction to open the intake passage 15 and rotates in clockwise direction to close the intake passage 15. Housing portions 1*a* and 1*b* are formed on both sides of the body 1 so as to surround each periphery of each end of the throttle shaft 4. At the right side surface of the body 1, a boss portion 1*c* is formed to support the right end of the throttle shaft 4.

An engaging gear 3 is fixed to the left end of the throttle shaft 4. To the left side housing portion 1*a* of the body 1, a control motor 2 and an opening angle sensor 14 are fixed. The control motor 2 is, for example, a step motor having a pinion 2*a* on its output shaft to mate with the engaging gear 3. Driving torque of the control motor 2 is transmitted from the output shaft of the motor 2 to the throttle shaft 4 via the pinion 2*a* and the engaging gear 3 to thereby open and close the throttle valve 5. An electrical system for transmitting torque from the control motor 2 to the shaft 4 is assembled on the left side of the body 1.

A computer 17 inputs data from various sensors (not shown). These sensors detects operational amount of the accelerator, an actuation condition of the engine and various driving conditions of the vehicle. The computer 17 outputs driving signal toward the motor 2 according to the detected operational amount of the accelerator and the actuation condition of the engine thus controlling power of the engine. The computer 17 is programmed to realize various control functions such as traction control, idle speed control, and constant speed running control. The opening angle sensor 14 has a detecting lever (not shown) which engages an interlocking lever 3*a* axially outwardly protruding from the engaging gear 3. An opening angle of the throttle valve 5 is detected by rotation of the engaging gear 3.

The throttle shaft 4 has a protruding shaft end 4*a* on its right side. Diametrically opposite portions of the protruding shaft end 4*a* are machined into flat surfaces having a cross section similar to the shape of an athletic field track. The protruding shaft end 4*a* has a throttle lever 7, a collar 11, a relief lever 6 and a guide lever 13 assembled in this order. Specifically, the throttle lever 7 is non-rotatably fitted to the protruding shaft end 4*a*. Then, the cylindrical collar 11 is rotatably mounted on the protruding shaft end 4*a*, and further, the relief lever 6 is rotatably mounted on the collar 11. Then the guide lever 13 is non-rotatably fitted to the protruding shaft end 4*a*. Then, by caulking the extreme end of the protruding shaft end 4*a*, not only the guide lever 13 can be prohibited from removing therefrom, but also the throttle lever 7, the collar 11 and the relief lever 6 are secured.

The throttle lever 7 has, on its outer periphery, a first engaging arm 7*a* and a second engaging arm 7*b*. As shown in FIG. 3, the first arm 7*a* is in the valve opening side (in a counterclockwise direction) of the second arm 7*b*. As shown in FIG. 1, the end portion of the first engaging arm 7*a* is bent toward the body 1 (toward the left side of FIG. 1) while the end portion of the second arm 7*b* is bent in the opposite direction.

A coil spring or a return spring 8 is mounted on the outer periphery of the boss portion 1*c* of the body 1. One end hook 8*a* of the return spring 8 engages a groove 16 formed on the wall of the body 1 while the other end hook 8*b* fixedly engages the first engaging arm 7*a* of the throttle lever 7. The return spring 8 biases the throttle lever 7 in the valve closing direction (clockwise direction in FIG. 3) with respect to the body 1.

Figure 5:
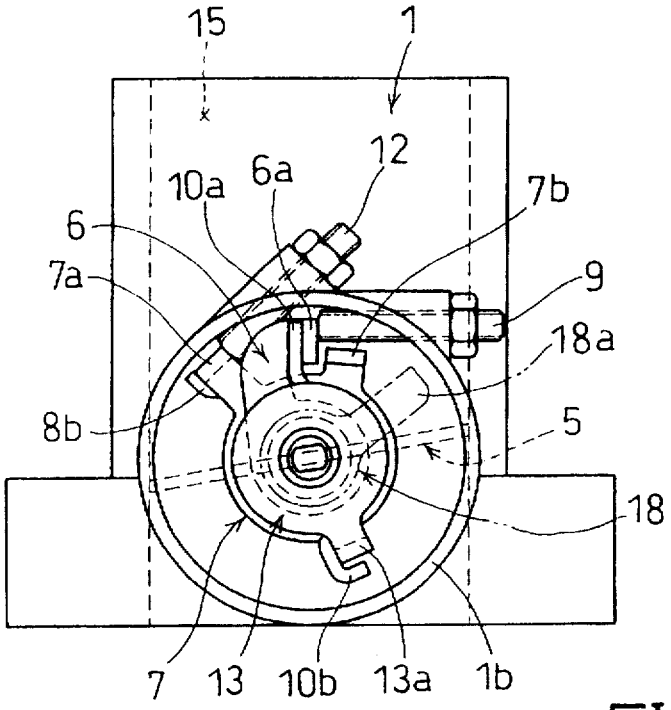
FIG. 5 is a view illustrating a state in which the throttle valve is fully closed by the control motor.
Figure 6:
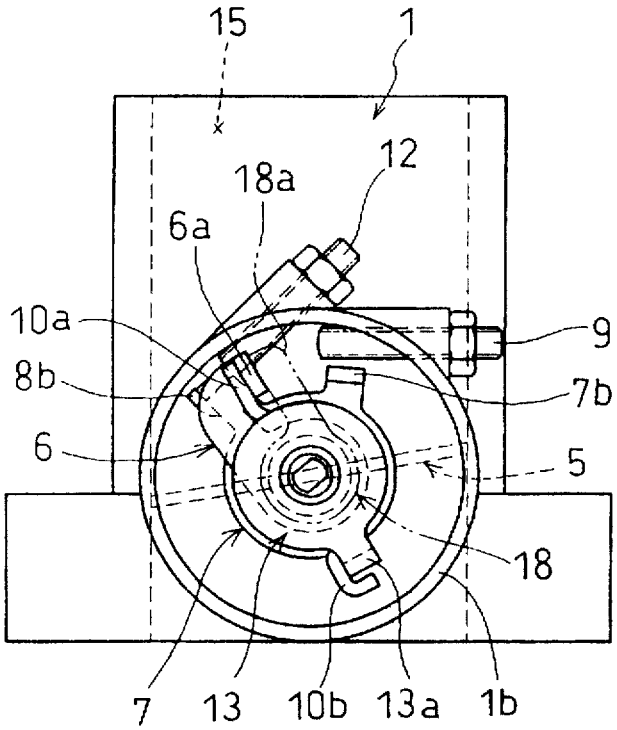
FIG. 6 is a view illustrating a state in which the throttle valve is traction-controlled.

A throttle lever stopper screw 12 is fastened to the housing portion 1*b* of the body 1. As shown in FIG. 5, when the throttle lever 7 is rotated in the valve closing direction, the throttle lever stopper screw 12 abuts on the first engaging arm 7*a* of the throttle lever 7, thus stopping the throttle valve 5 at its fully closed position (or idle opening angle). The throttle lever stopper screw 12 is arranged with its axis substantially parallel to a tangent line of the throttle lever 7. The contact position of the first engaging arm 7*a* and the throttle lever stopper screw 12 can be adjusted by screw-in and -out of the throttle lever stopper screw 12.

The relief lever 6 has an engaging arm 6*a* on its outer periphery. The engaging arm 6*a* is in the valve opening side (in a counterclockwise direction) of the second engaging arm 7*b* of the throttle lever 7. The end of the engaging arm 6*a* extends toward the right side in FIG. 1.

The guide lever 13 has on its outer periphery a guide lever arm 13*a* whose end portion is bent toward the left side in FIG. 1.

A coil spring or a relief spring 10 is interposed between the relief lever 6 and the guide lever 13. One end hook 10*a* of the relief spring 10 fixedly engages the engaging arm 6*a* of the relief lever 6 and the other end hook 10*b* fixedly engages the guide lever arm 13*a* of the guide lever 13. The relief spring 10 biases the throttle shaft 4 in the valve opening direction 20 (counterclockwise direction in FIG. 3) with respect to the relief lever 6, and biases the relief lever 6 in the valve closing direction (clockwise direction in FIG. 3) with respect to the throttle shaft 4. Consequently, the relief spring 10 biases the relief lever 6 to come into contact with the throttle lever 7 from a valve opening side of the throttle lever 7.

The relief spring 10 has a greater biasing force than that of the return spring 8. Therefore, normally, the biasing force of the relief spring 10 overcomes that of the return spring 8, so that the engaging arm 6*a* of the relief lever 6 can be maintained in contact with the second engaging arm 7*b* of the throttle lever 7. It should be noted that the engaging arms 6*a* and 7*a* constitute engaging members. The biasing force of the relief spring 10 is set to be smaller than the driving torque of the control motor 2 when the motor 2 is energized but greater than the motor torque when the motor is not energized.

A relief lever stopper screw 9 is fastened to the housing portion 1*b* of the throttle body 1. As shown in FIG. 1, the relief lever stopper screw 9 is in the right side of the throttle lever stopper screw 12 in the axial direction of the throttle shaft 4. When the relief lever 6 is rotated in the valve closing direction, the relief lever stopper screw 9 abuts on the engaging arm 6*a* of the relief lever 6 as shown in FIG. 3, thus stopping the rotation of the relief lever 6. In this state, the throttle lever stopper screw 12 is not contact with the first engaging arm 7*a* of the throttle lever 7. Specifically, where the throttle valve 5 is opened by a predetermined angle from the fully closed position (idle opening angle), the relief lever 6 comes into contact with the relief lever stopper screw 9. The opening angle of the throttle valve 5 in this state is referred to as initial opening angle hereinafter. The relief lever stopper screw 9 is disposed with its axis substantially parallel to a tangent line of the relief lever 6. The relief lever stopper screw 9 and the engaging arm 6*a* of the relief lever 6 constitute a stopper mechanism, and the contact position of the stopper mechanism can be adjusted by screw-in and -out of the relief lever stopper screw 9.

As shown in FIG. 1 at the right end of the housing portion 1*b* of the throttle body 1, a lid plate 21 is fixed to cover an opening. An accelerator shaft 22 is rotatably supported through a boss (unnumbered) of the lid plate 21. The accelerator shaft 22 is coaxially disposed with the throttle shaft 4. The lid plate 21 is best shown in FIG. 2 which is a side view in the direction of arrow II.

As shown in FIG. 1, a kick lever 18 is fixed at an end of the accelerator shaft 22 in the housing portion 1*b*. The kick lever 18 has an engaging portion 18*a* at a portion on its outer periphery. The engaging portion 18*a* is in the valve closing position (in a clockwise direction in FIG. 3) of the engaging arm 6*a* of the relief lever 6. The engaging portion 18*a* can engage the engaging arm 6*a*.

Figure 2:
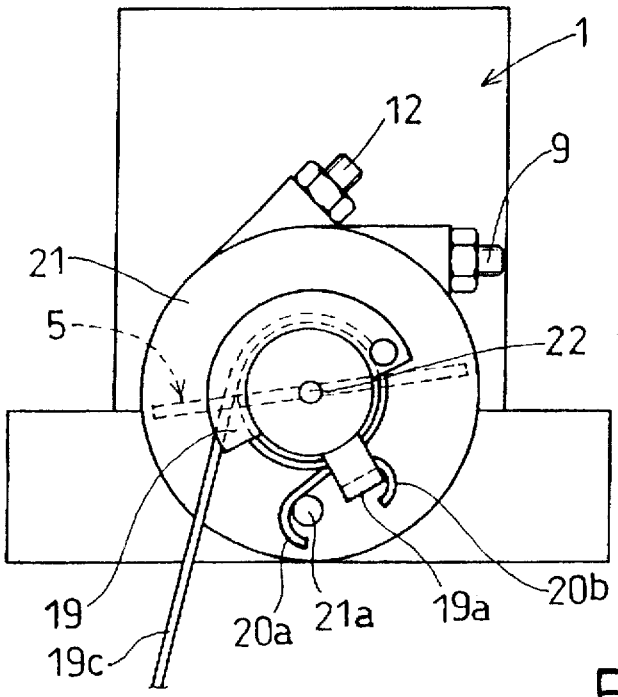
FIG. 2 is a side view of the throttle valve controller, looking in the direction of arrow II of FIG. 1.
Figure 3:
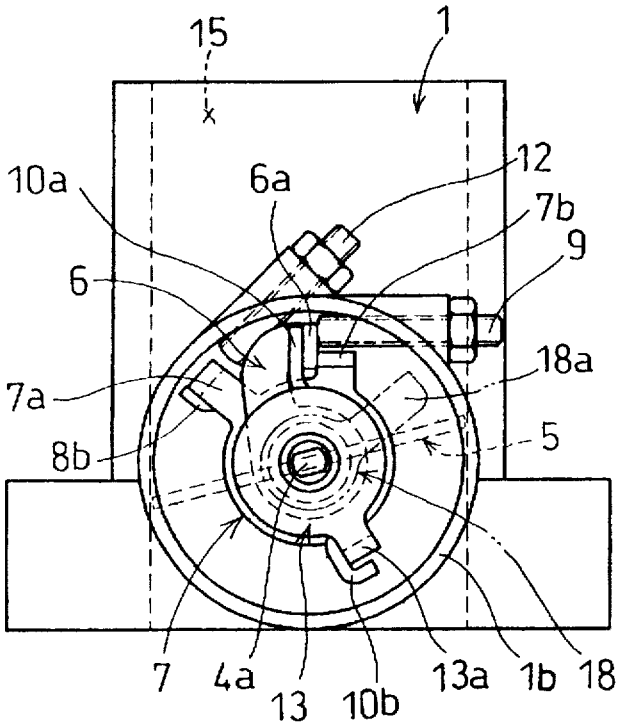
FIG. 3 is a side view taken along line III—III of FIG. 1.

As shown in FIG. 2, an accelerator lever 19 is fixed at the outer end of the accelerator shaft 22. The accelerator lever 19 is connected to an end of an accelerator control cable 19*c* operated by an accelerator pedal. By depressing the accelerator pedal, the accelerator control cable 19*c* rotates the accelerator lever 19 in the valve opening direction (counterclockwise direction).

A coil spring or accelerator return spring 20 is interposed between the lid plate 21 and the accelerator lever 19. One end hook 20*a* of the accelerator return spring 20 fixedly engages an engaging projection 21*a* of the lid plate 21 and the other end hook 20*b* thereof fixedly engages an engaging piece 19*a* of the accelerator lever 19. The accelerator return spring 20 biases the accelerator lever 19 in the valve closing direction.

Figure 7:
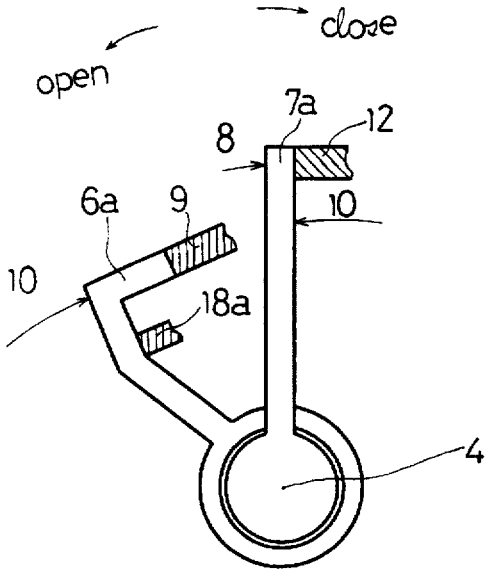
FIG. 7 is a view schematically illustrating the relation between a throttle lever and a relief lever when the throttle valve is fully closed by the motor.
Figure 8:
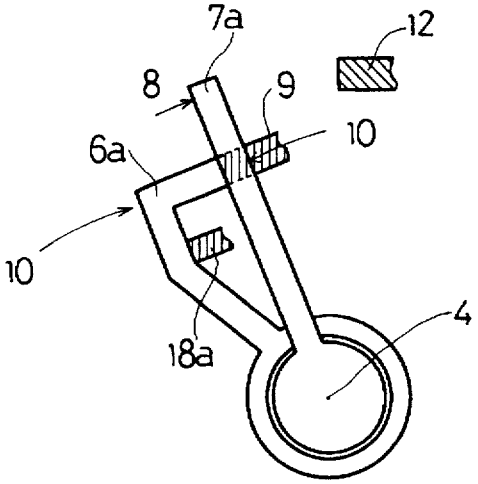
FIG. 8 is a view schematically illustrating the relation between the throttle lever and the relief lever when the motor is not energized and when the accelerator is not operated.

In the above-described throttle valve controller, when an engine is stopped, the engaging arm 6*a* of the relief lever 6 is placed in contact with the relief lever stopper screw 9 by the biasing force of the return spring 8 while it engages the second engaging arm 7*b* of the throttle lever 7 by the biasing force of the relief spring 10, as can be seen in FIG. 3 or 8. Unlike a conventional device in which a throttle valve is maintained in its valve closed position, the throttle valve 5 is maintained in a position slightly opened from its fully closed position (initial opening angle), thus preventing locking of the throttle valve 5 generated by freezing or by deposition of combustion products. Thus, the starting trouble of the engine is prevented by the embodiment. A schematic structure of this embodiment is shown in FIGS. 7 to 9.

Further, in a normal state of engine operation, the control motor 2 is driven according to an operational amount of the accelerator and actuation condition of the engine, and then the driving torque of the motor 2 is transmitted via the pinion 2*a* and the engaging gear 3 to the throttle valve 5 which is thereby opened and closed. At this time, as explanatorily shown in FIG. 5 or 7, when the throttle valve 5 is closed to an angle smaller than the initial opening angle, the throttle lever 7 is rotated in the valve closing direction against the biasing force of the relief spring 10 while the relief lever 6 is kept in contact with the relief lever stopper screw 9. Under this condition, a torque required for the motor can be reduced by the valve closing biasing force of the return spring 8.

Figure 4:
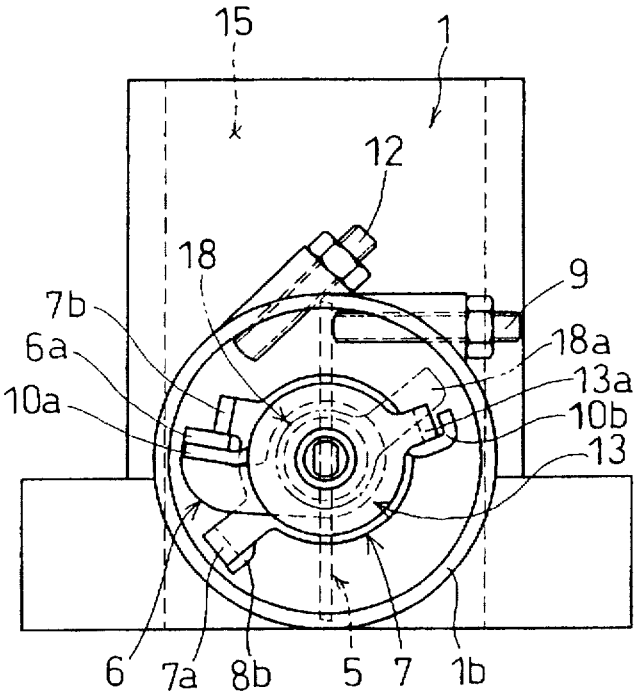
FIG. 4 is a view illustrating a state in which a throttle valve is fully opened by a control motor.
Figure 9:
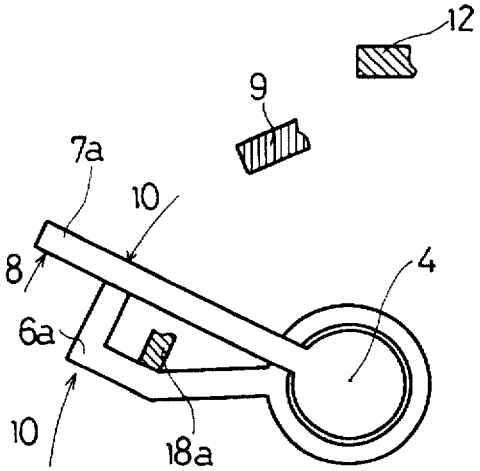
FIG. 9 is a view schematically illustrating the relation between the throttle lever and the relief lever when the accelerator is operated.

On the other hand, when the throttle valve 5 is opened to an angle greater than the initial opening angle, the throttle lever 7 and the relief lever 6 are rotated in the valve opening direction against the biasing force of the return spring 8 as explanatorily shown in FIG. 4 or 9. In this case, the throttle lever 7 and the relief lever 6 rotate together.

As is the case with the traction-controlled state in which an opening angle of the throttle valve 5 to be controlled by the control motor 2 is smaller than that by a rotation of the kick lever 18 by the accelerator operation, the engaging arm 6*a* of the relief lever 6 engages the engaging portion 18*a* of the kick lever 18 to thereby stop the valve closing rotation of the relief lever 6 (clockwise direction in FIGS. 6 and 9), thus rotating the throttle lever 7 in the valve closing direction against the biasing force of the relief spring 10. Also under this condition, a torque required for the motor can be reduced by the valve closing biasing force of the return spring 8.

During the actuation of the engine, in case a certain trouble in an electrical system causes the control motor 2 to stop its operation (non-energized condition), the throttle valve 5 is rotated to the initial opening angle as in the stopping condition of the engine (see FIGS. 3 and 8). Operation of the accelerator in this condition makes the engaging portion 18*a* of the kick lever 18 to engage the engaging arm 6*a* of the relief lever 6 to thereby rotate the relief lever 6 in the valve opening direction (counterclockwise direction in FIGS. 3 and 9). Thus, the throttle lever 7 having been maintained in an engaging condition with the relief lever 6 is rotated in the valve opening direction along with the relief lever 6. Accordingly, the throttle valve 5 can be mechanically controlled in association with the operation of the accelerator.

A load normally applied to the control motor 2 is the biasing force of the return spring 8 which is smaller than that of the relief valve 10. When the throttle valve 5 is rotated to an angle smaller than the initial angle or smaller than an angle determined by a position of the kick lever, the load applied to the motor is the biasing force of the relief spring 10 subtracted by that of the return spring 8. Thus, the load applied to the control motor 2 can be reduced.

The return spring 8 of the above-described throttle valve controller is allowed to be disposed at a position on either side where the accelerator lever 19 is assembled or where the engaging gear 3 is assembled, thus providing designing flexibility when considering down-sizing and layout of the device.

According to the throttle valve controller of the embodiment, locking of the throttle valve which would be caused by freezing or deposition of combustion products is avoided without prohibiting its function that the throttle valve is both electrically and mechanically controlled, thus improving the starting reliability of the engine.

While the invention has been described with reference to preferred embodiments thereof, it is to be understood that modifications or variations may be easily made without departing from the scope of the present invention which is defined by the appended claims.

What is claimed is:

1. A throttle valve controller for opening and closing a throttle valve by a torque generated either by a motor or by an operation of an accelerator by an operator, said controller comprising:

a throttle shaft (4) supported by a body (1) such that the throttle valve (5) can be rotated with said shaft (4) in an intake passage formed in said body for opening and closing the intake passage;

a motor (2) for rotating said throttle shaft (4);

a throttle lever (7) fixed to said throttle shaft (4);

a return spring (8) for biasing said throttle shaft (4) in a valve closing direction;

a relief lever (6) capable of rotating with respect to said throttle shaft (4);

a relief spring (10) interposed between said throttle shaft (4) and said relief lever (6) for biasing said throttle shaft (4) in a valve opening direction with respect to said relief lever (6) and for biasing said relief lever (6) in a valve closing direction with respect to said throttle shaft (4) by a biasing force greater than that of said return spring;

a first engaging member (6*a*) formed on said relief lever (6) for engaging said throttle lever (7), said relief lever (6) being positioned in the valve opening side of said throttle lever (7);

a stopper (9) for stopping rotation of said relief lever (6) in the valve closing direction at a position where said throttle valve (5) is opened by a predetermined angle from a fully closed position of said throttle valve;

a kick lever (18) adapted to be rotated by said operation of said accelerator; and a second engaging member (18*a*) formed on said kick lever (18) for engaging said relief lever (6) when said kick lever (18) is rotated in the valve opening direction greater than a predetermined angle, said kick lever (18) being positioned in the valve closing side of said relief lever (6).

2. The throttle valve controller as defined in claim 1, wherein a rotating torque of said motor is greater than the biasing force of said return spring.

* * * * *